US009368871B2

(12) United States Patent
Howard

(10) Patent No.: US 9,368,871 B2
(45) Date of Patent: Jun. 14, 2016

(54) FRACTIONAL BEAM FORMING NETWORK ANTENNA

(71) Applicant: John Howard, Upper Mount Bethel, PA (US)

(72) Inventor: John Howard, Upper Mount Bethel, PA (US)

(73) Assignee: John Howard, Upper Mount Bethel, PA (US)

( * ) Notice: Subject to any disclaimer, the term of this patent is extended or adjusted under 35 U.S.C. 154(b) by 515 days.

(21) Appl. No.: 13/793,162

(22) Filed: Mar. 11, 2013

(65) Prior Publication Data

US 2013/0241771 A1 Sep. 19, 2013

Related U.S. Application Data

(60) Provisional application No. 61/610,507, filed on Mar. 14, 2012.

(51) Int. Cl.

| | |
|---|---|
| ***H01Q 3/22*** | (2006.01) |
| ***H01Q 3/26*** | (2006.01) |
| ***H01Q 3/40*** | (2006.01) |
| ***H01Q 25/00*** | (2006.01) |

(52) U.S. Cl.

CPC ..... *H01Q 3/2682* (2013.01); *H01Q 3/40* (2013.01); *H01Q 25/00* (2013.01)

(58) Field of Classification Search

CPC ..... H01Q 3/22; H01Q 3/2682; H01Q 3/40; H01Q 25/00

USPC ..... 342/375

See application file for complete search history.

(56) References Cited

U.S. PATENT DOCUMENTS

| | | | | |
|---|---|---|---|---|
| 7,084,811 | B1 * | 8/2006 | Yap | 342/375 |
| 7,394,424 | B1 * | 7/2008 | Jelinek et al. | 342/375 |
| 2002/0159506 | A1 * | 10/2002 | Alamouti et al. | 375/147 |
| 2002/0181874 | A1 * | 12/2002 | Tulchinsky et al. | 385/39 |
| 2013/0229980 | A1 * | 9/2013 | Wernersson et al. | 370/328 |

* cited by examiner

*Primary Examiner* — Harry Liu

(74) *Attorney, Agent, or Firm* — Hoffmann & Baron, LLP

(57) ABSTRACT

A fractional beam forming network antenna includes a beam forming network and a plurality of antennas. The network includes input ports, output ports, and at least one delay device. The beam forming network couples input ports to the output ports through the at least one delay device. The antennas are vertically disposed relative to each other, and coupled to the output ports. At least two of the antennas include a different elevation tilt and/or azimuth rotation relative to each other. A method of fractional beam forming is provided, which includes coupling, using a beam forming network, input ports to output ports through at least one delay device; disposing a plurality of antennas vertically relative to each other; coupling the antennas to the output ports; and rotating at least two of the antennas in different elevation and/or different azimuth relative to each other.

20 Claims, 3 Drawing Sheets

FRACTIONAL BEAM FORMING NETWORK ANTENNA

CROSS-REFERENCE TO RELATED APPLICATION

This application claims the benefit of U.S. Provisional Application No. 61/610,507 filed on Mar. 14, 2012, the disclosure of which is incorporated herein by reference in its entirety.

BACKGROUND

1. Field

Embodiments of the invention generally relate to antennas and, more particularly, relate to devices and methods that increase capabilities of beam forming networks.

2. Related Art

Some of the major challenges in designing antenna beam forming networks and systems include reducing and/or eliminating dead zones and a lack of flexibility in terms of beam width and multiple input/multiple output (MIMO) capabilities.

SUMMARY OF THE INVENTION

In accordance with one embodiment, a fractional beam forming network antenna is provided, which includes a beam forming network and a plurality of antennas. The beam forming network includes a plurality of input ports, a plurality of output ports, and at least one delay device. The beam forming network couples the plurality of input ports to the plurality of output ports through the at least one delay device. The plurality of antennas is vertically disposed relative to each other, and is coupled to the plurality of output ports. At least two of the plurality of antennas include a different elevation tilt and/or a different azimuth rotation relative to each other.

The beam forming network may include but is not limited to a 4×4 beam forming network, a 4×8 beam forming network, and/or an 8×8 beam forming network. Any combination of antennas to beams may be used in the embodiments disclosed herein. The delay device may be active and/or passive. The plurality of antennas may include an antenna column, which includes a plurality of antenna elements vertically disposed relative to each other. The plurality of antennas may include a plurality of antenna columns, and each of the plurality of antenna columns may include a plurality of antenna elements vertically disposed relative to each other. A beam width associated with the antenna column may be narrowed as a quantity of antenna elements associated with the antenna column is increased, and beam patterns associated with the plurality of antennas may overlap. The different elevation tilt associated with at least two of the plurality of antennas may be used to direct a beam pattern associated with at least two of the plurality of antennas to cover different distances from at least two of the plurality of antennas. The at least one delay device may include an adjustable delay, thereby enabling modification of a direction of a beam pattern associated with the plurality of antennas.

In accordance with another embodiment, a method of fractional beam forming is provided, which includes coupling, using a beam forming network, a plurality of input ports to a plurality of output ports through at least one delay device; disposing a plurality of antennas vertically relative to each other; coupling the plurality of antennas to the plurality of output ports; and rotating at least two of the plurality of antennas in at least one of different elevation and different azimuth relative to each other.

The method may include disposing the plurality of antennas vertically relative to each other in an antenna column. The method may include narrowing a beam width associated with the antenna column, and increasing a quantity of antenna elements associated with the antenna column. The method may include overlapping beam patterns associated with the plurality of antennas, and rotating the elevation tilt associated with at least two of the plurality of antennas to direct a beam pattern associated with at least two of the plurality of antennas to cover different distances from at least two of the plurality of antennas. The method may include adjusting the at least one delay device to modify direction of a beam pattern associated with the plurality of antennas.

Other embodiments of the invention will become apparent from the following detailed description considered in conjunction with the accompanying drawings. It is to be understood, however, that the drawings are designed as an illustration only and not as a definition of the limits of any embodiments of the invention.

BRIEF DESCRIPTION OF THE DRAWINGS

The following drawings are provided by way of example only and without limitation, wherein like reference numerals (when used) indicate corresponding elements throughout the several views, and wherein.

It is to be appreciated that elements in the figures are illustrated for simplicity and clarity. Common but well-understood elements that are useful or necessary in a commercially feasible embodiment are not shown in order to facilitate a less hindered view of the illustrated embodiments.

DETAILED DESCRIPTION

Embodiments disclosed herein are configured to increase capabilities of beam forming networks and systems, which include doubling the total number of beams, providing multiple input-multiple output (MIMO) capability, and eliminating dead zones. Conventional beam forming systems typically exhibit dead zones, as well as reduced flexibility in terms of the beam width of the antenna and MIMO capabilities. One method of achieving these goals involves the use of a plurality of different large antennas, such as eight (8) antennas, each of which provides a narrow beam. However, this technique is both more costly and occupies a greater amount of space.

Embodiments disclosed herein accomplish these capabilities by utilizing an antenna system with two antennas and one beam forming network that provides dual beams, in which each antenna has a slightly different vertical (elevation) tilt and/or horizontal (azimuth) tilt (what is an acceptable range of variation for which the tilts can differ in degrees or radians). This results in a decrease in beam overlap and an increase in beam coverage. In addition, these embodiments provide for dead zone elimination since if one antenna has a dead zone, the second antenna does not exhibit the same dead zone since the second antenna is displaced in azimuth and/or elevation relative to the first antenna.

Figure 1:
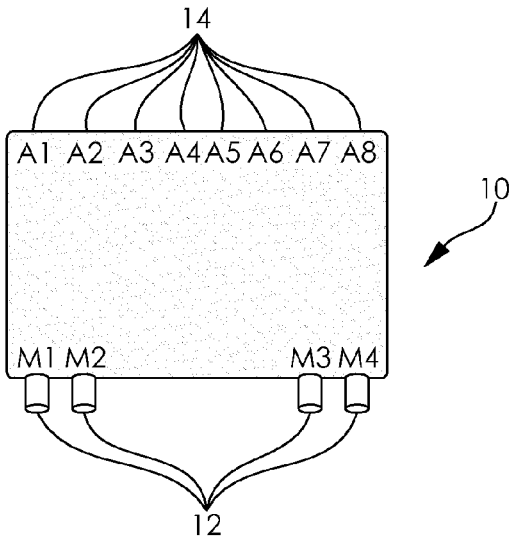
FIG. 1 shows a 4×8 beam forming network, which provides four (4) input ports and eight (8) antenna output ports.

FIG. 1 shows a 4×8 beam forming network 10, which includes four (4) input ports M1, M2, M3, M4 12, and eight (8) output ports A1, A2, A3, A4, A5, A6, A7, A8 14. Although the 4×8 beam forming network 10 has been selected as an example, embodiments disclosed herein are equally applicable to other beam forming configurations, such as 8×8, 4×4, 16×16, 4×8, 8×4, 16×8, 8×16, etc.

Figure 2:
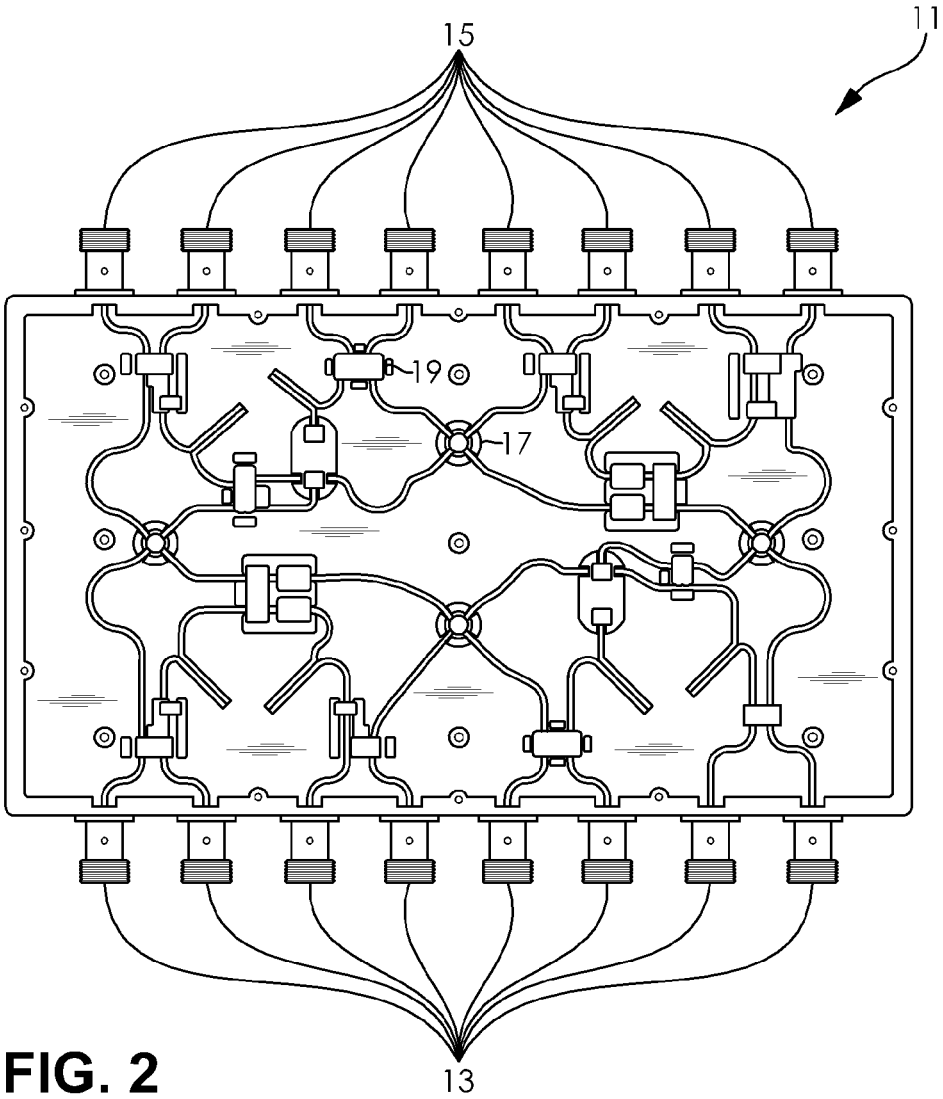
FIG. 2 shows an 8×8 beam forming network, which provides eight (8) input ports and eight (8) antenna output ports.
Figure 4:
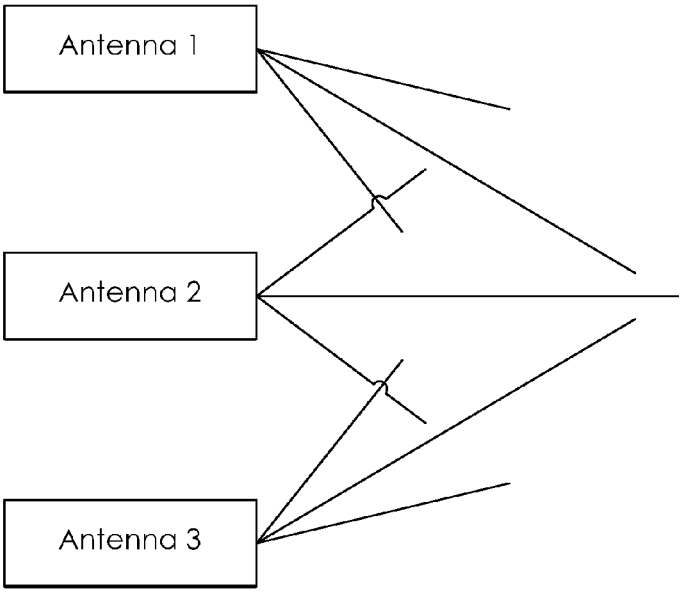
FIG. 4 shows an example of overlapping antenna beam patterns.
Figure 5:
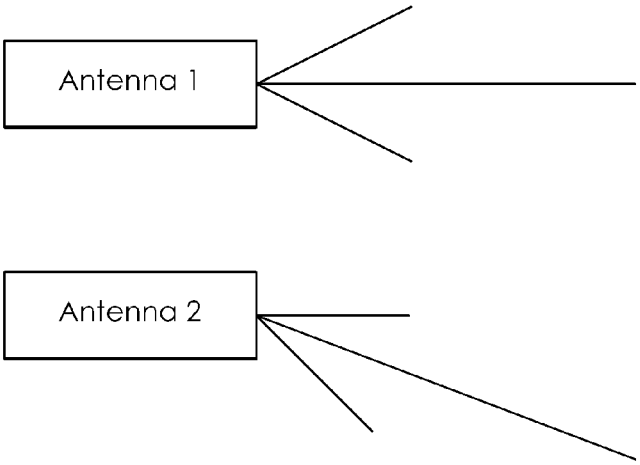
FIG. 5 shows an example of covering different distances with different antennas.

FIG. 2 shows an 8×8 beam forming network 11, which includes eight (8) inputs 13 and eight (8) antenna outputs 15. The devices 17, 19 may be passive or active components, but in this case the components 17, 19 are passive. Each device 17, 19 creates a delay to an antenna output 15. By changing the delay of the signal to one or more of the antenna outputs 15, the signal from each antenna column will collide at different times, thereby creating signals from each antenna column having the greatest power in different directions and at different locations. The upper eight (8) ports 15 shown in FIG. 2 are connected to eight (8) antennas, and the lower eight (8) ports 13 are used as inputs.

Figure 3:
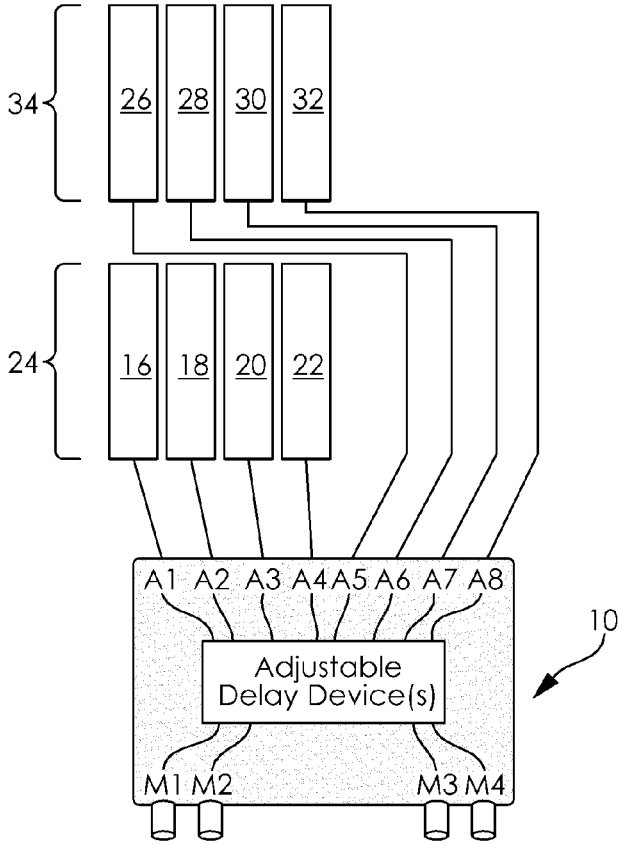
FIG. 3 shows an embodiment utilizing the 4×8 beam forming network shown in FIG. 1, which includes two four-column antennas vertically disposed on top of each other.

In certain configurations, each output of the beam forming network 10 shown in FIGS. 1 and 3 is coupled to a different column associated with one eight (8) column antenna. However, in the embodiment shown in FIG. 3, more than one antenna 24, 34 are coupled to one beam forming network 10. Accordingly, one beam forming network 10 can be connected to two (2) four (4)-column antennas 24, 34, as shown in FIG. 3.

As described above with reference to FIG. 1, the output ports 14 of the beam forming network 10 are referred to by references A1, A2, A3, A4, A5, A6, A7, and A8. As shown in FIG. 3, a lower four (4) output ports A1, A2, A3, A4 14 are connected to columns 16-22 of a lower antenna 24, and an upper four (4) output ports A5, A6, A7, A8 14 are connected to columns 26-32 of an upper antenna 34. Specifically, output port A1 is connected to a first column 16 of the lower antenna 24, output port A2 is connected to a second column 18 of the lower antenna 24, output port A3 is connected to a third column 20 of the lower antenna 24, and output port A4 is connected to a fourth column 22 of the lower antenna 24. Similarly, output port A5 is connected to a first column 26 of the upper antenna 34, output port A6 is connected to a second column 28 of the upper antenna 34, output port A7 is connected to a third column 30 of the upper antenna 34, and output port A8 is connected to a fourth column 32 of the upper antenna 34. Each column includes multiple elements in the vertical direction. As the number of elements is increased in a column, the beam width is narrowed in elevation.

In the embodiments disclosed herein, a single antenna provides four beams with a 30° beam width. In embodiments disclosed herein, two (2) antennas provide eight (8) beams with a 30° beam width, including two (2) beams in each direction. If the antennas are vertically disposed relative to each other or the antennas are vertically aligned with a significant amount of spacing, the beam patterns of the two antennas overlap. This feature causes the resulting antenna system to be 2×2 MIMO and 4×4 MIMO compatible or non-MIMO compatible for dual or single polarized systems. A dual polarized system may propagate signals in which energy oscillates in two orthogonal directions, such as up and down (vertically) and/or left and right (horizontally). Such a configuration provides two different techniques for transmitting and receiving information. A 2×2 MIMO has four (4) different links between the transmitter and receiver while an 8×8 MIMO has eight (8) different links between the transmitter and receiver. In accordance with embodiments disclosed herein, the number of beams associated with the antenna may be doubled, tripled, quadrupled, and the like depending on the selected beam forming antenna configuration. For example, if dual four (4)-beam antennas are stacked vertically on top of each other, wherein each antenna has a different tilt and each antenna provides four (4) beams, then the number of beams is doubled. Alignment of beam overlap is configurable such that 2×2 MIMO or 4×4 MIMO is achieved.

In the disclosed embodiments, an antenna provides one main beam and side lobes, which are disposed on both sides of the main beam. The regions between the main beam and the side lobes are referred to as dead zones, in which the radiating signal is attenuated or absent. In accordance with embodiments disclosed herein, by tilting one or both of the antennas in elevation, or in azimuth, the beam patterns of the two antennas are aligned such that the beam pattern associated with one of the antennas covers the dead zones associated with the other antenna, thereby eliminating or reducing dead zones associated with the resulting antenna system. To eliminate dead zones, antennas are rotated horizontally (azimuth) and/or tilted vertically (elevation) depending on the configuration and/or environmental conditions, such as the presence of tall buildings, mountains, and the like. Such obstructions are eliminated by varying the rotation or tilt of antennas in the system. If both near distances and far distances are to be covered at the same time, horizontal rotation and/or vertical tilting may be utilized. For example, if the two antennas are vertically disposed on top of one another, one antenna may be tilted down to cover the closer distances, while the remaining antenna may be tilted down slightly less to cover the longer distances. Tilting or rotating angles are specific to configuration of the antenna and the beam forming network, as well as environmental conditions. These angles can be calculated theoretically or can be determined by conducting a site survey.

Although a 4×8 beam forming network 10 coupled with two (2) four (4)-column antennas 24, 34 are shown in FIG. 3 and described herein, embodiments of the invention are equally applicable to any alternative configuration, such as a 4×8 beam forming network with four (4) two (2) column antennas, a 4×4 beam forming network with two (2) two (2) column antennas, a 16×16 beam forming network, and the like. Each type of beam former may have a different number of beams. As the number of beams increases in a sector, the beams become narrower and are displaced to different locations. A 4×8 beam forming network may have beams disposed at locations different than an 8×8 beam forming network. In order to achieve different beam locations, the delay for each of the outputs of the antenna may vary.

An alternate technique to realize the advantages of the disclosed embodiments includes utilizing a plurality of different large antennas, each of which exhibits a narrow beam width. However, such a technique is more costly and occupies substantially greater area than the embodiments disclosed herein.

Accordingly, embodiments of the invention improve the flexibility of beam forming networks. In some applications, embodiments of the invention double the number of beams provided by beam forming networks. By having two antennas vertically stacked on top of each other, each of which provides the same number of beams, the total number of beams is doubled. In some applications, embodiments of the invention render beam forming networks 2×2 MIMO and 4×4 MIMO (for dual or single polarized systems) compatible or non MIMO compatible. If a single polarization system is used, which includes two antennas stacked on top of each other, then the unit is a 2×2 MIMO system with each system being 1×1 MIMO (1 transmit port, 1 receive port). If a dual polarization system is used, which includes two antennas vertically stacked on top of each other, each system is 2×2 MIMO, thereby providing a total system that is 4×4 MIMO.

Although the specification describes components and functions implemented in the embodiments with reference to particular standards and protocols, the embodiment are not limited to such standards and protocols.

The illustrations of embodiments described herein are intended to provide a general understanding of the structure of various embodiments, and are not intended to serve as a complete description of all the elements and features of apparatus and systems that might make use of the structures described herein. Many other embodiments will be apparent to those of skill in the art upon reviewing the above description. Other embodiments are utilized and derived therefrom, such that structural and logical substitutions and changes are made without departing from the scope of this disclosure. Figures are also merely representational and are not drawn to scale. Certain proportions thereof are exaggerated, while others are decreased. Accordingly, the specification and drawings are to be regarded in an illustrative rather than a restrictive sense.

Such embodiments of the inventive subject matter are referred to herein, individually and/or collectively, by the term "embodiment" merely for convenience and without intending to limit the scope of this application to any single embodiment or inventive concept. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single embodiment. Thus the following claims are hereby incorporated into the detailed description, with each claim standing on its own as a separate example embodiment.

The abstract is provided to comply with 37 C.F.R. §1.72(b), which requires an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single embodiment. Thus the following claims are hereby incorporated into the Detailed Description, with each claim standing on its own as separately claimed subject matter.

Although specific example embodiments have been described, it will be evident that various modifications and changes are made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and without limitation, specific embodiments in which the subject matter are practiced. The embodiments illustrated are described in sufficient detail to enable those skilled in the art to practice the teachings herein. Other embodiments are utilized and derived therefrom, such that structural and logical substitutions and changes are made without departing from the scope of this disclosure. This Detailed Description, therefore, is not to be taken in a limiting sense, and the scope of various embodiments is defined only by the appended claims, along with the full range of equivalents to which such claims are entitled.

Given the teachings of the invention provided herein, one of ordinary skill in the art will be able to contemplate other implementations and applications of the techniques of the invention. Although illustrative embodiments of the invention have been described herein with reference to the accompanying drawings, it is to be understood that the invention is not limited to those precise embodiments, and that various other changes and modifications are made therein by one skilled in the art without departing from the scope of the appended claims without departing from the scope of the appended claims.

What is claimed is:

1. A fractional beam forming network antenna, which comprises:

a beam forming network, the beam forming network comprising a plurality of input ports, a plurality of output ports, and at least one delay device, the beam forming network coupling the plurality of input ports to the plurality of output ports through the at least one delay device, the beam forming network selectively coupling a radio frequency signal from any of the plurality of input ports to any of the plurality of output ports; and a plurality of antennas, the plurality of antennas being vertically disposed relative to each other, the plurality of antennas being coupled to the plurality of output ports, at least two of the plurality of antennas comprising at least one of a different elevation tilt and a different azimuth rotation relative to each other.

2. The fractional beam forming network antenna, as defined by claim 1, wherein the beam forming network comprises a 4×4 beam forming network.

3. The fractional beam forming network antenna, as defined by claim 1, wherein the beam forming network comprises a 4×8 beam forming network.

4. The fractional beam forming network antenna, as defined by claim 1, wherein the beam forming network comprises an 8×8 beam forming network.

5. The fractional beam forming network antenna, as defined by claim 1, wherein the delay device is active.

6. The fractional beam forming network antenna, as defined by claim 1, wherein the delay device is passive.

7. The fractional beam forming network antenna, as defined by claim 1, wherein the plurality of antennas comprises an antenna column, the antenna column comprising a plurality of antenna elements vertically disposed relative to each other.

8. The fractional beam forming network antenna, as defined by claim 7, wherein the plurality of antennas comprises a plurality of antenna columns, each of the plurality of antenna columns comprising a plurality of antenna elements vertically disposed relative to each other.

9. The fractional beam forming network antenna, as defined by claim 7, wherein a beam width associated with the antenna column is narrowed as a quantity of antenna elements associated with the antenna column is increased.

10. The fractional beam forming network antenna, as defined by claim 1, wherein beam patterns associated with the plurality of antennas overlap.

11. The fractional beam forming network antenna, as defined by claim 1, wherein the different elevation tilt associated with at least two of the plurality of antennas is used to direct a beam pattern associated with at least two of the plurality of antennas to cover different distances from at least two of the plurality of antennas.

12. The fractional beam forming network antenna, as defined by claim 1, wherein the at least one delay device comprises an adjustable delay, thereby enabling modification of a direction of a beam pattern associated with the plurality of antennas.

13. A method of fractional beam forming, which comprises:

coupling, using a beam forming network, a plurality of input ports to a plurality of output ports through at least one delay device, the beam forming network selectively coupling a radio frequency signal coupled to any one of the plurality of input ports to any one of the plurality of output ports;

disposing a plurality of antennas vertically relative to each other; and coupling the plurality of antennas to the plurality of output ports, at least two of the plurality of antennas comprising at least one of a different elevation tilt and a different azimuth rotation relative to each other.

14. The method of fractional beam forming, as defined by claim 13, wherein the delay device is active.

15. The method of fractional beam forming, as defined by claim 13, wherein the delay device is passive.

16. The method of fractional beam forming, as defined by claim 13, further comprising disposing the plurality of antennas vertically relative to each other in an antenna column.

17. The method of fractional beam forming, as defined by claim 16, further comprising:

narrowing a beam width associated with the antenna column; and increasing a quantity of antenna elements associated with the antenna column.

18. The method of fractional beam forming, as defined by claim 13, further comprising overlapping beam patterns associated with the plurality of antennas.

19. The method of fractional beam forming, as defined by claim 13, further comprising rotating the elevation tilt associated with at least two of the plurality of antennas to direct a beam pattern associated with at least two of the plurality of antennas to cover different distances from at least two of the plurality of antennas.

20. The method of fractional beam forming, as defined by claim 13, further comprising adjusting the at least one delay device to modify direction of a beam pattern associated with the plurality of antennas.

* * * * *